United States Patent [19]

Bähr et al.

[11] 4,405,091

[45] Sep. 20, 1983

[54] APPARATUS FOR THE PRODUCTION OF MECHANICAL WOOD PULP

[75] Inventors: Theodor Bähr; Hans-Otto Heinrich; Helmut Thumm, all of Heidenheim, Fed. Rep. of Germany

[73] Assignee: J. M. Voith GmbH, Heidenheim, Fed. Rep. of Germany

[21] Appl. No.: 255,849

[22] Filed: Apr. 20, 1981

[30] Foreign Application Priority Data

Apr. 24, 1981 [DE] Fed. Rep. of Germany ..... 3015722

[51] Int. Cl.[3] ..... B02C 23/38

[52] U.S. Cl. ..... 241/33; 241/152 A; 241/282

[58] Field of Search ..... 241/28, 33, 46 R, 152 A, 241/280, 282

[56] References Cited

U.S. PATENT DOCUMENTS

| | | | |
|---|---|---|---|
| 3,528,618 | 9/1970 | Ullner | 241/282 |
| 3,690,568 | 9/1972 | Alexander | 241/282 X |
| 3,693,891 | 9/1972 | Remmer | 241/282 X |
| 4,270,703 | 6/1981 | Haikkala | 241/28 X |

FOREIGN PATENT DOCUMENTS

| | | | |
|---|---|---|---|
| 742830 | 5/1943 | Fed. Rep. of Germany | 241/282 |

*Primary Examiner*—Howard N. Goldberg

*Attorney, Agent, or Firm*—St. Onge, Steward, Johnston & Reens

[57] ABSTRACT

An apparatus for controlling the level and discharge of a suspension or slurry of ground wood in a mechanical wood pulp forming process is described. The apparatus includes, below a wood grinder, a trough in which a slurry of ground wood is formed. The ground wood slurry is passed through a discharge port, which is located near the trough bottom, into a conduit in which a valve is located. The valve is controlled by a slurry level sensor so as to maintain the slurry level at a desired level at least higher than the discharge port. A wood chip cutter is employed at the discharge port and is sized to minimize blockage and facilitate removal of the slurry from the trough. In one form of the invention an apparatus for pressurizing the housing enclosing the wood grinder is described and in another form an open housing structure is shown and described.

12 Claims, 2 Drawing Figures

APPARATUS FOR THE PRODUCTION OF MECHANICAL WOOD PULP

FIELD OF THE INVENTION

This invention generally relates to a device for the production of mechanical wood pulp. More specifically, this invention relates to an apparatus for controlling the flow of ground wood generated in the mechanical manufacture of wood pulp.

BACKGROUND OF THE INVENTION

Mechanical wood pulp forming devices have become known, such as described in U.S. Pat. No. 4,274,600. Typically such device contains a gas-pressurized grinder housing having supply chutes which are alternatively and selectively opened and closed so that wood stock, such as in the form of sticks, can be supplied into the pressurized housing without loss of its pressurization. With such pressurized grinder housing, one can produce mechanical wood pulp under a pressure higher than atmospheric pressure with the ground wood being collected as a slurry below the grinder. However, control of the height of the slurry or the liquid suspension of ground wood in the trough and pressurization of the grinder housing require relatively expensive and cumbersome additional equipment.

For example, an overflow dam is used in the trough below the grinder to control the level of the slurry in the trough. Such dam tends to collect chips and thus interfere with the proper operation of the dam, particularly when such dam is to be adjustable during operation of the mechanical grinding. Downstream of such dam and in case of a gas pressurized housing, a pressure lock is used with which air contained in the slurry of mechanical wood pulp is separated. Behind such pressure lock a valve is used and controlled by the gas pressure in the pressure lock to control the discharge of the slurry from the pressure lock.

SUMMARY OF THE INVENTION

In an apparatus in accordance with the invention for the mechanical manufacture of wood pulp, the slurry of ground wood below a grinder is conveniently discharged from the housing in which the grinder is located whether the housing is pressurized or not. This is obtained as described with reference to one form of the invention with a discharge conduit which is located at least below the upper level of the slurry and as described in one embodiment near the bottom of the trough in which the ground wood is collected. The discharge conduit is in direct communication with the slurry below the grinder, thus rendering blockage thereof less likely and reducing or preventing the entrainment of gas in the discharge of the slurry of ground wood from a gas pressurized housing.

As further described with reference to one form of the invention, the level of the slurry in the trough below the grinder is maintained by use of a level sensor, a valve in the conduit and a control which, in response to a signal from the level sensor, actuates the valve to maintain the slurry level at a desired level or at least above the discharge port.

In one form of the invention a wood chip cutter is employed at the discharge port of the trough and is sized so as to operatively extend along the trough bottom with a length approximately equal to the width of the trough at its discharge port. In this manner improved flow of the slurry of ground wood is obtained with less chance for blockage.

It is, therefore, an object of the invention to provide a simplified control over the level and discharge of a slurry of mechanical wood pulp formed in a wood grinding operation. It is a further object of the invention to provide an improved discharge of a slurry of ground wood in a gas-pressurized wood grinding operation.

These and other objects and advantages of the invention can be understood from the following detailed description of several embodiments described in conjunction with the drawings.

DETAILED DESCRIPTION OF THE DRAWINGS

Figure 1:
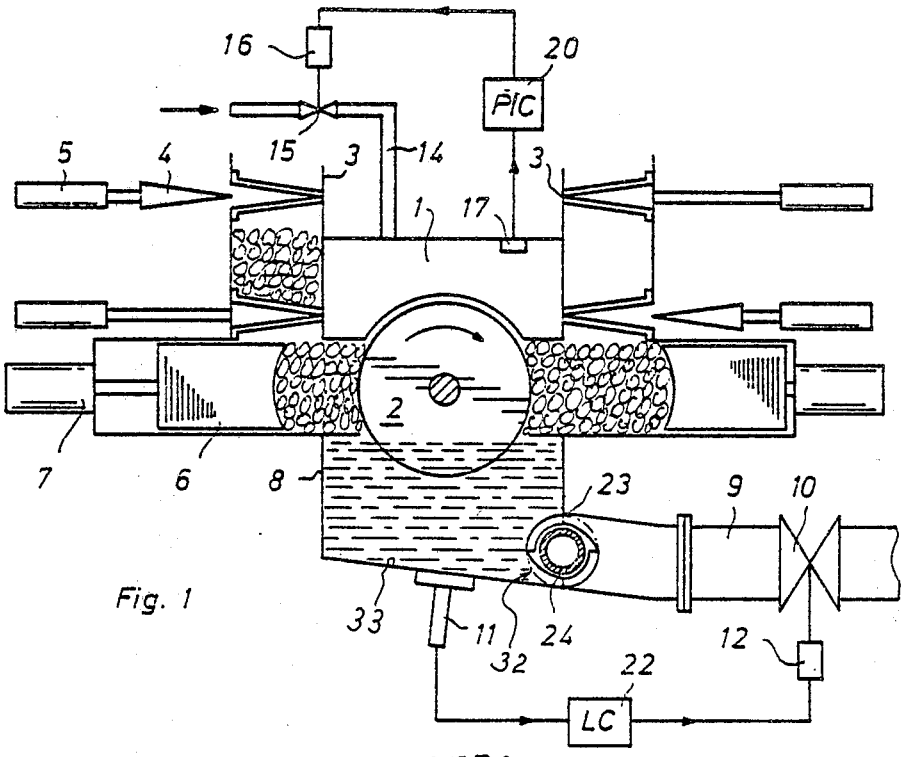
FIG. 1 is a vertical section and schematic diagram view of one apparatus in accordance with the invention.

With reference to FIG. 1, 1 denotes a grinder housing, 2 a grinding stone, 3 supply chutes through which wood stock in the form of sticks are supplied through pressure lock type control valves 4. Valves 4 are actuated by hydraulic servomotors 5.

The wood stock is supplied into housing 1 in front of pressure pistons 6 which press the wood stock against the grinding stone 2. Pistons 6 are actuated by hydraulic servomotors 7 which, in cooperation with a grind stone 2, produce a slurry of ground wood in a trough 8 below the grind stone 2. Liquid for the formation of the slurry is provided through conduits not shown. The trough 8 has a slurry discharge port 32 located near the bottom 33 of trough 8 and through which the slurry is removed. A discharge conduit 9 is coupled to discharge port 32 and is in direct communication, i.e. without an intervening dam, with the slurry of the ground wood below the grinder 2. A wood chip cutter 23 with a cutting element 24 is employed at the discharge port 32 and extends along bottom 33 (out of the plane of the drawing in a direction transverse to the flow of the ground wood slurry into conduit 9). The operative length of cutter 23, along trough bottom 33 is approximately equal to the width of the trough at the discharge port 32.

A valve 10 for the control of the removal of the mechanical wood pulp suspension in trough 8 is connected in the discharge conduit 9. Valve 10 is controlled by a servomotor 12 as a function of the level of the ground wood slurry in trough 8 as obtained with a level sensor such as a pressure transducer 11. The signal from pressure transducer 11 is applied to a controller 22, LC, meaning level controller, and which in turn supplies a signal to actuate motor 12. The pressure transducer 11 may be located at the bottom 33 of trough 8 or near its bottom. The controller 22 provides the servomotor 12 with a signal for actuation of valve 10 so as to maintain the slurry in trough 8 at a desired level or at least above the discharge port 32.

The discharge port 32 and conduit 9 are located practically at the bottom 33 of trough 8 and preferably are at its lowest point. In either case port 32 and conduit 9 are below the lowest liquid level that is to be established in trough 8. Hence, it is hardly possible for air to enter into the conduit 9 whereby additional expensive air removing and pressure lock equipment, such as described in the aforementioned U.S. Pat. No. 4,274,600, is unnecessary and deleted.

Furthermore, the grinder housing 1 may be pressurized with gas through a gas supply line 14. A valve 15 is located in line 14 and is in turn controlled through a controller 20, PIC, meaning pressure indicating and control, a servomotor 16 and a signal from a pressure transducer 17 to maintain the gas pressure at the desired level.

The arrangement and design of the wood chip cutter 23 according to the invention, with a length of its operating cutting element designed to correspond almost or approximately to the width of the trough at port 32, can also be used advantageously for grinders operating under atmospheric pressure. With a wood chip cutter having an operating length which corresponds almost or approximately to the width of the trough 8 at the discharge port 32 blockage of the inlet opening leading to the wood chip cutter is prevented. With this invention a highly improved method of operation for the control of the liquid level in the trough 8 and of the pressure in the grinder housing 1 is obtained.

Although the invention has been described and is preferably used with a wood grinder operated above atmospheric pressure, the slurry level and discharge control from the trough according to the invention can also be advantageously applied to wood grinders operated at atmospheric pressure. Thus, with reference to FIG. 2, a continuous wood grinder is shown with chain-band-like transporting devices 30, to which wood stock is supplied by means of a conveyor belt 31. A similar arrangement as shown in FIG. 1 for the control and discharge of the ground wood slurry in the trough 8 in accordance with the invention is illustrated.

Figure 2:
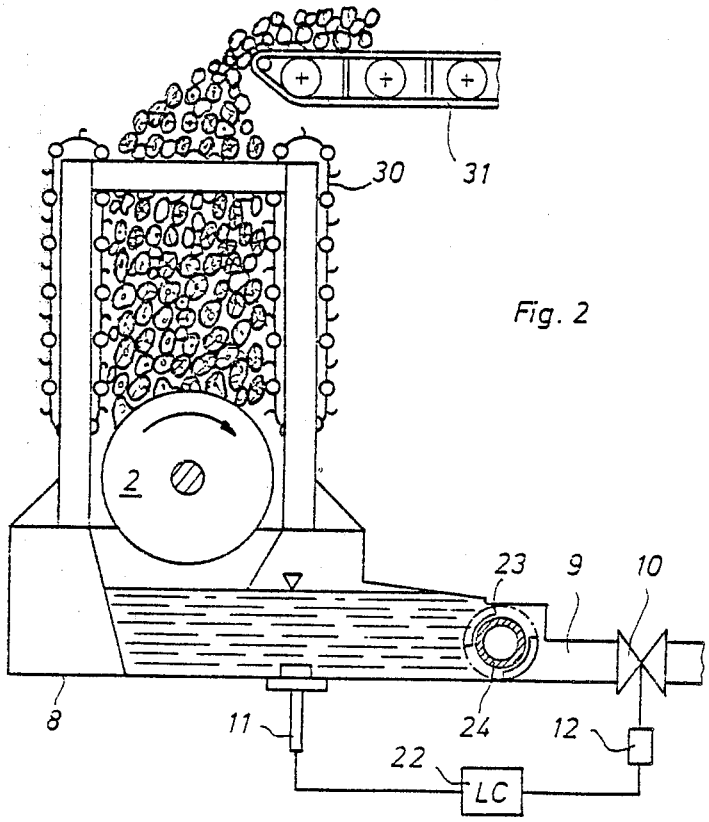
FIG. 2 is a vertical section and schematic diagram view of another apparatus in accordance with the invention.

The grinder housing in FIG. 2 has an open design and operates under atmospheric pressure. The apparatus of FIG. 2, however, can also be designed with a pressurizable housing and pressure locks such as provided by slide valves 4 according to FIG. 1.

Having thus described the invention, its advantages can be appreciated. Changes from the described embodiments can be made by one skilled in the art without departing from the scope of the invention.

What is claimed is:

1. In an apparatus for the mechanical production of wood pulp with a grinder located in a housing into which wood stock is fed to be ground up by the grinder for the formation of a slurry of ground wood in a trough below the grinder, the improvement comprising:

a discharge conduit coupled to the trough at a discharge port thereof, said discharge port being located below the upper level of the slurry of ground wood, said conduit further being in unrestricted ground wood flow communication with the slurry of ground wood below the grinder;

a wood chip cutter operatively interposed with the conduit at the trough discharge port; and means for maintaining the upper level of said slurry of wood pulp above the discharge port.

2. The improved apparatus for the mechanical production of wood pulp as claimed in claim 1:

wherein said wood chip cutter has a cutter element which is aligned generally along the trough bottom at the discharge port, said cutter element being sized to have an operating length which is approximately the same as the width of the trough at said discharge port.

3. The improved apparatus for the mechanical production of wood pulp as claimed in claim 2 and further including:

means for pressurizing said housing above atmospheric pressure.

4. An apparatus for the manufacture of wood pulp with a grinder located in a housing in which wood stock is ground up to form a slurry of mechanically ground wood in a trough located below the grinder, comprising:

a discharge conduit unrestrictively coupled to a lower end of the trough to convey ground wood therefrom;

a valve interposed in the conduit; and means for generating a signal indicative of the level of the slurry in the trough to actuate the valve and control the discharge of ground wood from the trough through said conduit while maintaining the slurry level above the discharge conduit.

5. The apparatus for the manufacture of wood pulp as claimed in claim 4 wherein said means further includes:

a level sensor located near the bottom of the trough.

6. The apparatus for the manufacture of wood pulp as claimed in claim 5 wherein said level sensor is formed of a pressure transducer which produces an electrical signal indicative of the level of the ground wood slurry in the trough.

7. The apparatus for the manufacture of wood pulp as claimed in claim 6 wherein said signal generating means further includes:

a valve drive coupled to actuate the valve in the discharge conduit; and a slurry level control responsive to the signal from the pressure transducer and coupled to the valve drive to cause said valve actuation.

8. The apparatus for the manufacture of wood pulp as claimed in claim 4 wherein said trough has a discharge port located near the bottom of said trough with a width substantially the same as the width of the trough at said discharge port, said discharge conduit being coupled to and commensurately sized with said discharge port, and a wood chip cutter located at said discharge port and being sized commensurate with the width thereof.

9. The apparatus for the manufacture of wood pulp as claimed in claims 4, 5, 6, 7, or 8 wherein said housing is pressurized with a supply of gas and further including:

a valve coupled to regulate the supply of gas;

means for sensing the gas pressure in said housing and generating a gas pressure signal indicative thereof; and means for applying the gas pressure signal to the valve coupled to the supply of gas to maintain the gas pressure in the housing at a desired level.

10. An apparatus for the mechanical production of wood pulp with a grinder located in a housing pressurized with a gas from a supply with wood stock being fed through a pressure lock into the housing to be ground up by the grinder for formation of a slurry of ground wood in a trough below the grinder, comprising:

a discharge conduit coupled to a discharge port located at a lower end of the trough to convey ground wood therefrom, said discharge conduit being in unrestricted ground wood flow communication with the slurry of ground wood below the grinder;

valve means interposed in the conduit for regulating the flow of ground wood slurry from the trough; and means coupled to the trough for generating a signal indicative of the level of the slurry of ground wood therein and actuate said valve means for regulation of the flow of ground wood from the trough.

11. The apparatus for the mechanical production of wood pulp as claimed in claim 10 and further including a wood chip cutter operatively located at the discharge port of the trough, said wood chip cutter having a cutter element aligned along the bottom of the trough at the discharge port and being sized generally commensurate with the width of the trough at said discharge port.

12. An apparatus for the mechanical production of wood pulp as claimed in claims 10 or 11 and further including:

a valve located to control the flow of gas from the supply into the housing;

means for sensing the gas pressure in the housing and producing a signal indicative thereof; and means responsive to the gas pressure signal for actuating the valve located to control the gas flow and maintain the gas pressure in the housing at a desired level.

* * * * *